US006402252B1

(12) United States Patent
Dickson

(10) Patent No.: US 6,402,252 B1
(45) Date of Patent: Jun. 11, 2002

(54) ROAD-CUTTING APPARATUS

(75) Inventor: Wayne E. Dickson, Tecumseh, OK (US)

(73) Assignee: Dickson Industries, Inc., Tecumseh, OK (US)

( * ) Notice: Subject to any disclaimer, the term of this patent is extended or adjusted under 35 U.S.C. 154(b) by 0 days.

(21) Appl. No.: 09/459,126

(22) Filed: Dec. 10, 1999

(51) Int. Cl.[7] ..... E01C 23/16
(52) U.S. Cl. ..... 299/39.6; 404/94
(58) Field of Search ..... 299/36.1, 37.1, 299/39.1, 39.4, 39.6, 76; 172/395, 397, 669; 37/412; 404/90, 94

(56) References Cited

U.S. PATENT DOCUMENTS

| | | | | | |
|---|---|---|---|---|---|
| 4,025,819 | A | * | 5/1977 | Lafever et al. | 361/236 |
| 4,157,877 | A | * | 6/1979 | Lee | 404/128 |
| 4,463,989 | A | * | 8/1984 | Kennedy | 299/39.1 |
| 4,832,412 | A | * | 5/1989 | Bertrand | 299/39.3 |
| 4,900,094 | A | * | 2/1990 | Sergeant | 299/39.1 |
| 5,046,890 | A | | 9/1991 | Dickson | 404/90 |
| 5,054,989 | A | * | 10/1991 | Fell | 414/607 |
| 5,129,755 | A | | 7/1992 | Dickson | 404/90 |
| 5,236,278 | A | | 8/1993 | Dickson | 404/90 |
| 5,297,894 | A | * | 3/1994 | Yenick | 404/94 |
| 5,299,857 | A | * | 4/1994 | Zanetis | 299/39.1 |
| 5,378,080 | A | | 1/1995 | Dickson | 404/90 |
| 5,391,017 | A | * | 2/1995 | Thomas et al. | 404/94 |
| 5,415,495 | A | | 5/1995 | Johnson | 404/84.05 |
| 5,676,490 | A | * | 10/1997 | Nelson | 404/94 |
| 6,247,757 | B1 | * | 6/2001 | Cochran | 299/39.6 |

OTHER PUBLICATIONS

Melroe Company "Pavement Repair with the Bobcat Planer" May 1997.*

* cited by examiner

*Primary Examiner*—H. Shackelford
*Assistant Examiner*—John Kreck
(74) *Attorney, Agent, or Firm*—McAfee & Taft

(57) ABSTRACT

A road-cutting apparatus for creating grooves or impressions in a road surface. The apparatus comprises a tool carrier with a rotatable cutter positioned adjacent thereto. A positioning control arm is hydraulically actuated to place the cutter in an operating position just above the road surface, and an operating control arm is hydraulically actuated to move the cutter into and out of cutting engagement with the road surface. The cutting is automatically carried out in response to a signal generated as a result of the distance traveled along the road surface by the apparatus. The road-cutting apparatus also comprises a transport wheel which can be placed into engagement with the road surface such that the cutter is spaced therefrom for transport of the apparatus to a desired location for cutting the grooves or impressions and raised above the road surface for the cutting operation.

19 Claims, 4 Drawing Sheets

ROAD-CUTTING APPARATUS

BACKGROUND OF THE INVENTION

1. Field of the Invention

This invention relates to machines used for scarifying, abrading and generally treating the surface of roadways, and more particularly, to a road-cutting apparatus which can be intermittently actuated automatically, as the apparatus moves along the road surface, to create spaced impressions or grooves in the roadway surface while allowing manual compensation for cutter wear.

2. Description of the Prior Art

On the shoulders along roadways, it is frequently a desired option to cut impressions or grooves extending laterally across the shoulder-to act as a warning for drivers that they have moved off the main roadway. When the tires of the vehicle contact the grooves, a noise is heard and vibration is felt which alerts the driver that the tires are in contact with the shoulder. Alternatively, ridges may be laid along the shoulder. In either case, the warning effect is the same, and such devices are frequently referred to as "rumble strips."

The spacing of these grooves varies depending upon the locale. For example, some states may use a different spacing than others. Also, in some areas, it is desired to use a larger spacing between groups of grooves. For example, there may be a group of a specific number of grooves which have a relatively small spacing therebetween and then a much larger space between the next set of grooves of that specific number. Generally, this type of spacing is referred to as intermittent cutting.

One prior art device utilizes a cam-like wheel which engages the surface, and as the device moves along the roadway, the cam rotates. This causes a cutter wheel to be alternately lowered into cutting contact with the road surface and raised out of contact. By moving this device along the road surface, a plurality of spaced grooves may be formed. This device has the disadvantage of not easily accommodating intermittent cutting. Also with the cam device, the spacing between adjacent grooves can only be controlled by changing the cam. There is no quick adjustment available. The present invention solves this problem by providing an apparatus which uses a microprocessor to control the spacing between adjacent grooves, and the microprocessor can also be programmed to provide a preset, larger spacing between sets of grooves to allow automatic intermittent cutting.

Another prior art device uses a hydraulic cylinder which raises and lowers the cutter into contact with the road surface. Such a device is disclosed in U.S. Pat. No. 5,415,495. This device has the disadvantage of requiring a highly specialized vehicle of which the cutting apparatus is an integral part. It is not adapted for use with common vehicles, such as farm tractors. The present invention solves this problem by providing a self-contained apparatus which can easily be pulled behind any number of known vehicles, such as farm tractors.

A cutter drum assembly for cutting grooves or impressions in a road surface is disclosed in U.S. Pat. Nos. 5,046,890; 5,129,755; 5,236,278; and 5,378,080. This, or other types of rotary cutters, may be utilized in the apparatus of the present invention.

The present invention also provides an apparatus which can be conveniently moved along a road surface when not in operation but can be quickly and easily placed into an operating position when desired, while at the same time providing automatic cutting of the grooves and also providing control of the cutter to compensate for wear thereon.

SUMMARY OF THE INVENTION

The present invention is an apparatus for cutting impressions or grooves in a road surface. The apparatus generally comprises a tool carrier adapted for moving along the road surface, a rotatable cutter positioned adjacent to the tool carrier, a cutter positioning means for positioning the cutter between a raised position spaced from the road surface and an operating position adjacent to the road surface, and a cutter operating means for alternately moving the cutter into and out of cutting engagement with the road surface after the cutter is in the operating position thereof A transport wheel is attached to the tool carrier and has a transport position engaging the road surface and a retracted or raised position spaced from the road surface. A wheel actuation means is used for moving the transport wheel between the transport and retracted positions thereof.

The wheel actuation means comprises a transport control arm pivotally connecting the transport wheel to the tool carrier and a transport cylinder connect to the tool carrier and the transport control arm, whereby the transport control arm and the transport wheel may be pivoted with respect to the tool carrier.

The cutter positioning means comprises a positioning control arm pivotally attached to the tool carrier and a positioning cylinder interconnecting the positioning control arm and the cutter whereby the cutter may be pivoted between the raised and operating pistons thereof The cutter positioning means may be used for pivoting the cutter with respect to the tool carrier for compensating for wear on cutting elements on the cutter.

The cutter operating means comprises an operating control arm attached to the cutter and an operating cylinder interconnecting the positioning control arm and the operating control arm whereby the cutter may be engaged and disengaged with the road surface. The cutter operating means is adapted for pivoting the cutter with respect to the tool carrier when moving the cutter between cutting engagement with the road surface and disengagement therefrom.

The apparatus further comprises an elevating wheel connected to the cutter for supporting the cutter on the road surface when the cutter is in the operating position thereof and when the cutter is cuttingly engaged with the road surface. The elevating wheel is connected to the positioning control arm and pivotable therewith.

Preferably, the apparatus further comprises a means for measuring a distance the tool carrier is moved along the road surface and generating a signal in response thereto and a logic controller actuating the cutter operating means in response to the signal. This may be used to control the width and depths of the grooves or impressions and also the spacing therebetween. It may also be used to control the longer spacing between groups of grooves or impressions during intermittent cutting.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
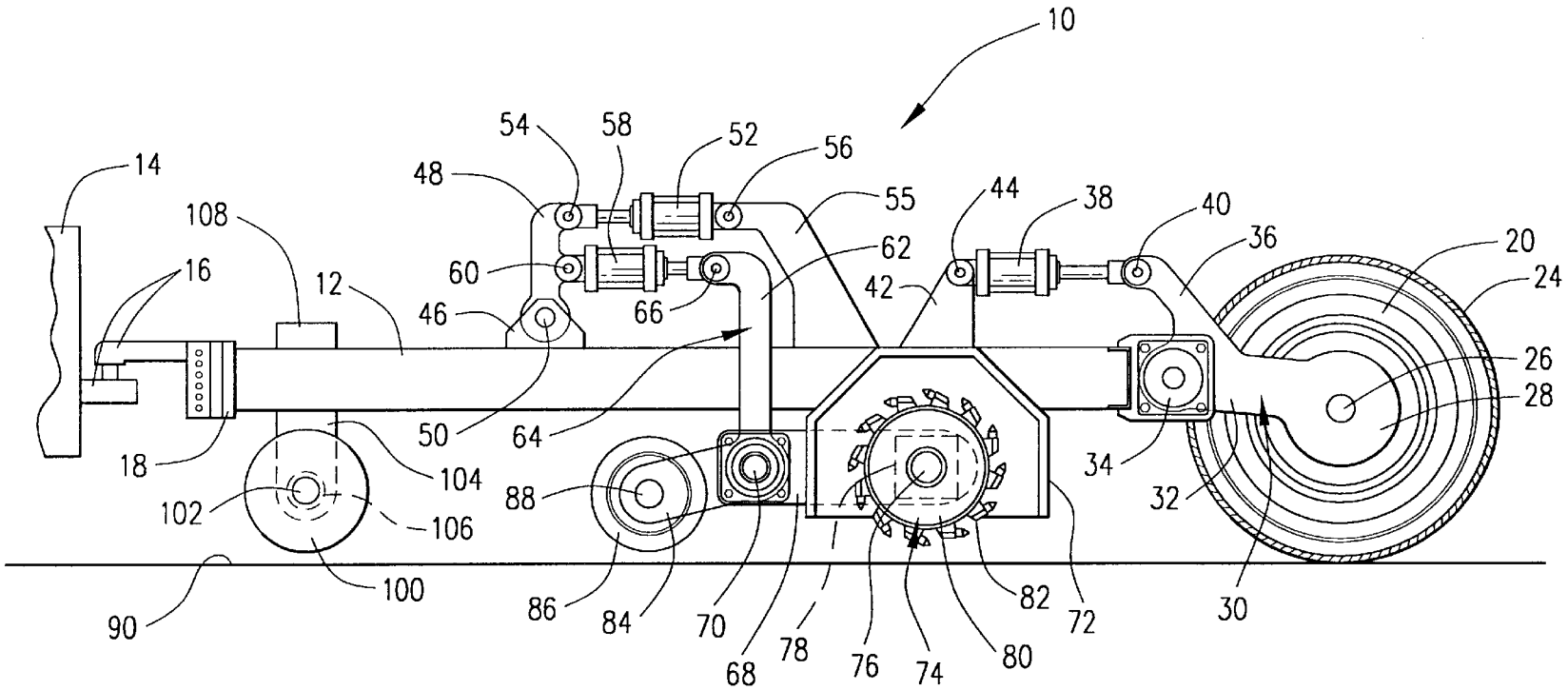
FIG. 1 shows the road-treating apparatus of the present invention in a transport position for movement along a road surface prior to treatment thereof.

Referring now to the drawings, and more particularly to FIG. 1, the road-cutting apparatus of the present invention is shown and generally designated by the numeral 10. Apparatus 10 comprises a frame or tool carrier 12 which in the illustrated embodiment is adapted for connection to a vehicle 14 by a trailer hitch 16 of a kind known in the art at a forward end 18 of the tool carrier. An advantage of apparatus 10 is that vehicle 14 can be almost anything, for example, a farm tractor. A specialized vehicle 14 is not required. Alternatively, apparatus 10 can be a self-contained vehicle with its own power source (not shown) on board.

A transport wheel 20 is positioned adjacent to a rearward end 22 of tool carrier 12. In the preferred embodiment, a pair of transport wheels 20 are utilized and positioned at generally opposite lateral sides of the apparatus. Wheel 20 is of a kind generally known in the art and preferably has a tire 24 thereon and is rotated about an axle 26. Axle 26 is connected to a rear portion 28 of a first control arm 30. First control arm 30 may also be referred to as transport control arm 30. An intermediate portion 32 of transport control arm 30 is connected to rear end 22 of tool carrier 12 by a pivot 34.

Transport control arm 30 also has a forward portion 36. A first hydraulic cylinder 38, also referred to as a transport cylinder 38, has one end thereof attached to forward portion 36 of transport control arm 30 at a pivot 40. The other end of transport cylinder 38 is connected to a cylinder bracket 42 by another pivot 44. Cylinder bracket 42 is fixedly attached to tool carrier 12.

A control arm bracket 46 is fixedly attached to tool carrier 12. A second control arm 44 is attached to control arm bracket 46 by a lower pivot 50. Second control arm 48 may also be referred to as a positioning control arm.

A second hydraulic cylinder 52 has one end attached to positioning control arm 48 by an upper pivot 54. Second hydraulic cylinder 52 may be referred to as positioning cylinder 52. The other end of positioning cylinder 52 is attached to a cylinder bracket 55 by a pivot 56. Cylinder bracket 55 is fixedly attached to tool carrier 12.

A third hydraulic cylinder 58 is attached to positioning control arm 48 by an intermediate pivot 60. Third hydraulic cylinder 58 may also be referred to as an operating cylinder 58. The other end of operating cylinder 58 is connected to an upper portion 62 of a third control arm 64 by a pivot 66. Third control arm 64 may also be referred to as an operating control arm 64. The maximum extension and retraction of operating cylinder 58 may be controlled as further described herein.

Operating control arm 64 is connected to a cutter frame 68 by a pivot 70. Cutter frame 68 is connected to, or forms a portion of, a cutter housing 72. A cutter drum assembly 74 is disposed in cutter housing 72 and rotatably mounted on cutter frame 68 by a cutter shaft 76. Cutter shaft 76, and thus cutter drum assembly 74, may be rotated by a prime mover 78. Prime mover 78 may be of any kind known in the art, such as a hydraulic motor, an internal combustion engine, an electric motor, etc.

Cutter drum assembly 74 itself is a prior art device comprises a cutter drum 80 with a plurality of cutter elements 82 attached to the outer surface thereof. Cutter elements 82 may be of any kind known in the art and are preferably replaceable and interchangeable with other cutter elements so that they may be easily replaced as desired.

A lower portion 84 of operating control arm 64 extends downwardly and forwardly from pivot 70. An elevation wheel 86 is rotatably connected to lower portion 84 of operating control arm 64 by an axle or shaft 88. Preferably, there are two laterally spaced elevations wheels 86 generally aligned with the ends of cutter drum assembly 74.

A measuring wheel 100 is rotatably mounted on a shaft or axle 102 and attached to tool carrier 12, such as by bracket 104. A distance counter wheel 106 is also mounted on shaft 102 and is rotatable with measuring wheel 100 which is always engaged with road surface 90. Distance counter wheel 106 is part of a logic control circuit 108 which includes electronic and hydraulic components.

Figure 4:
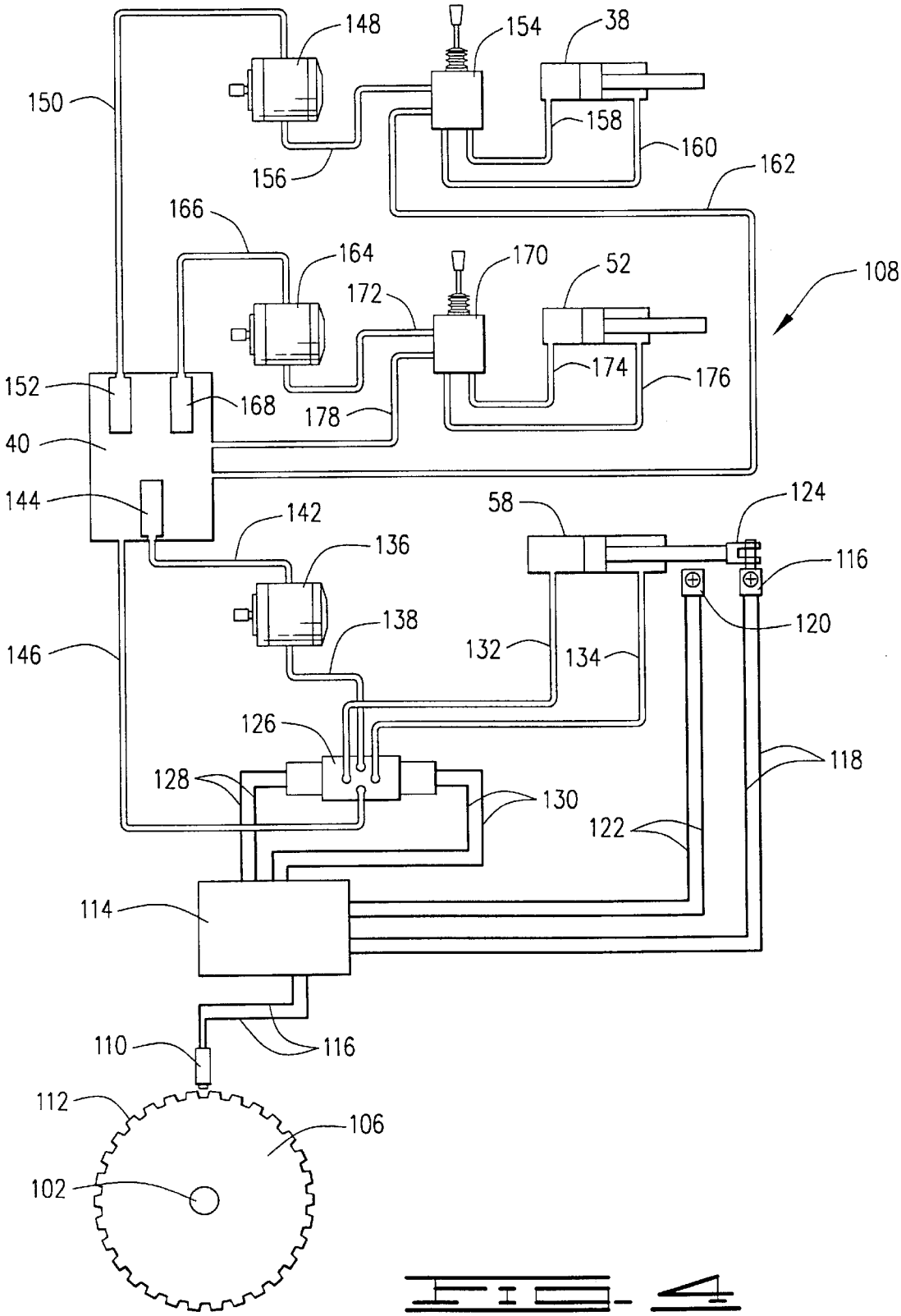
FIG. 4 is a schematic of the logic control circuit used in the apparatus.

Referring now to FIG. 4, the details of logic control circuit 108 are shown. A magnetic proximity switch 110 is positioned adjacent to distance counter wheel 106, and is adapted to detect the movement of cogs 112 on the distance counter wheel as they move past the proximity switch. Magnetic proximity switch 110 is connected to a distance logic controller 114 by wires 116.

A first cylinder proximity switch 116 is connected to controller 114 by wires 118, and a second cylinder proximity switch 120 is connected to controller 114 by wires 122. As will be further described herein, first cylinder proximity switch 116 and second cylinder proximity switch 122 are adapted to sense the presence of rod end 124 of operating cylinder 58 when positioned thereto. The longitudinal positioning of first cylinder proximity switch 116 and second cylinder proximity switch 120 may be adjusted longitudinally with respect to operating cylinder 58, and as will be further described herein, this allows control of the stroke of operating cylinder 58 and thus the cutting position of cutter drum assembly 74.

A three-position electric solenoid hydraulic valve 126 is connected to controller 114 by wires 128 and 130. Hydraulic valve 126 is hydraulically connected to operating cylinder 58 by hydraulic lines 132 and 134. Hydraulic valve 126 is connected to a hydraulic pump 136 by a line 138. Hydraulic pump 136 is hydraulically connected to a hydraulic reservoir 140 by a line 142. A hydraulic suction filter 144 may be used with line 142. Hydraulic pump 136 may also be referred to as operating hydraulic pump 136.

A hydraulic return line 146 extends from hydraulic valve 126 to reservoir 140.

Another hydraulic pump 148 which may be referred to as transport hydraulic pump 148 is connected to reservoir 140 by a line 50 and a hydraulic suction filter 152. Hydraulic pump 148 is connected to a transport control valve 154 by a line 146. Transport control valve 154 is hydraulically connected to transport cylinder 38 by lines 158 and 160. A hydraulic return line 162 extends from transport control valve 154 to reservoir 140. Transport control valve 154 is illustrated as a manual or hand valve, but could also be an electronic solenoid valve.

A further hydraulic pump 164, which may also be referred to as positioning hydraulic pump 164, is connected to reservoir 140 by a line 166 and another hydraulic suction filter 168. Positioning hydraulic pump 164 is connected to a positioning control valve 170 by a line 172. Positioning control valve 170 is hydraulically connected to positioning cylinder 52 by lines 174 and 176. A hydraulic return line 178 extends from positioning control valve 170 to reservoir 140. Positioning control valve 170 is illustrated as a manual or hand valve, but could also be an electronic solenoid valve.

While control circuit 108 has been illustrated as mounted on apparatus 10, it could also be mounted on vehicle 10 or at any other location which would be convenient for the operator of the apparatus. Also, while three different hydraulic pumps 136, 148 and 164 have been shown, it will be seen by those skilled in the art that one or more of these could be combined and still provide the appropriate hydraulic pressure to actuate any or all of cylinders 38, 52 and 58.

In an alternate embodiment, transport wheel 20 and trailer hitch 16 can be mounted on opposite ends so that transport wheels 20 are adjacent to elevation wheels 86. The invention is not intended to be limited to the specific configuration shown in the drawings.

OPERATION OF THE INVENTION

Figure 2:
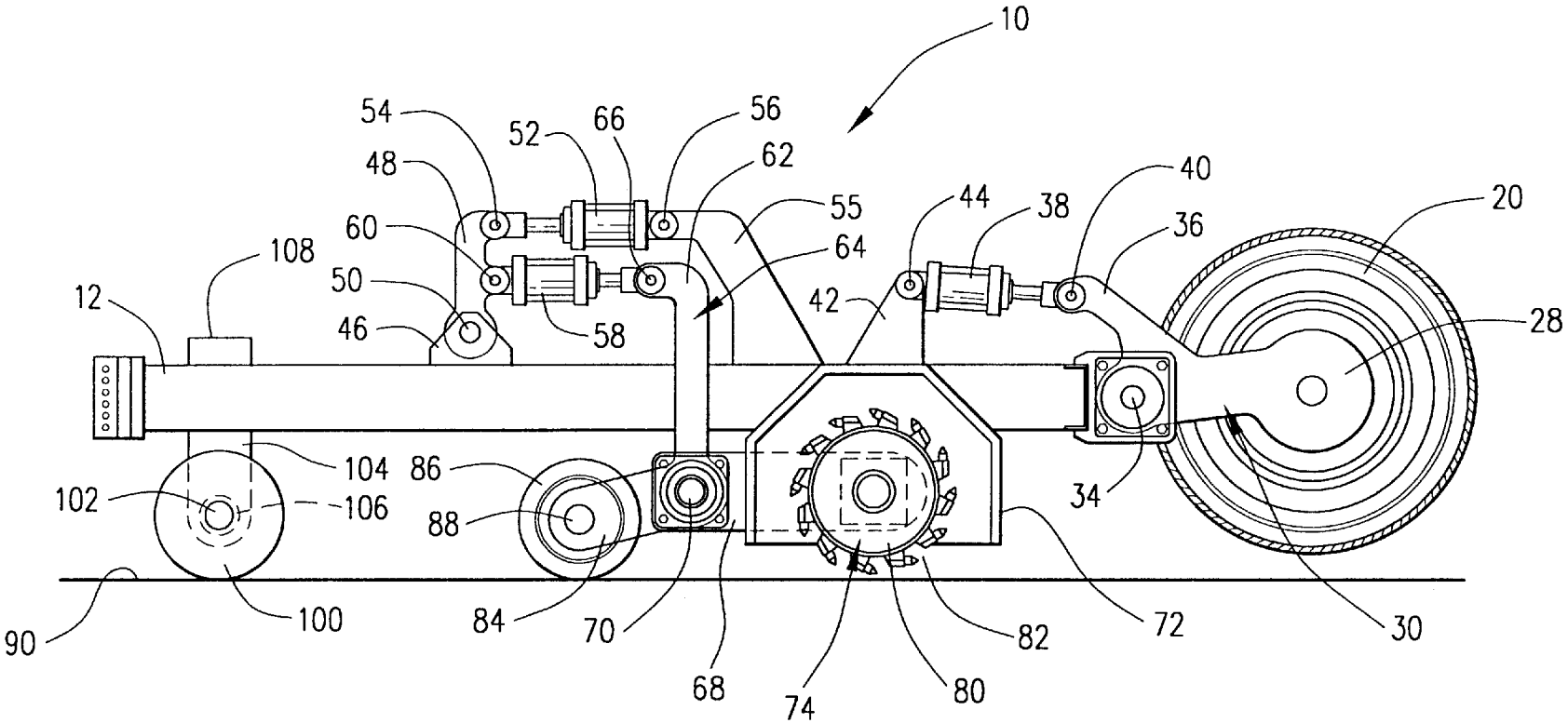
FIG. 2 shows the road-treating apparatus in an operating position in which the cutter is adjacent to the road surface.

Referring again to FIGS. 1 and 4, transport cylinder 38 is shown in an extended position such that transport wheels 20 are in their lowermost position so that road-cutting apparatus 10 may be pulled or driven along a road surface 90 with elevation wheels 86 and cutter drum assembly 74 spaced above the road surface. When apparatus 10 is at the desired location, pumps 136, 148 and 164 are turned on. Then, transport control valve 154 is operated to actuate transport cylinder 38 to a retracted position as shown in FIG. 2. This pulls on forward portion 36 of transport control arm 30 which rotates rear portion 28 of transport control arm 30 and wheels 20 about pivot 34 in a counterclockwise direction as seen in the drawings. As transport wheels 20 are raised, the rest of apparatus 10 is correspondingly lowered until elevation wheels 86 and measuring wheel 100 contact ground surface 90. Further actuation of transport cylinder 38 will raise transport wheels 20 above road surface 90 as shown in FIG. 2. Thus, apparatus 10 has a transport wheel actuation means for moving transport wheels 20 between the transport and retracted positions thereof.

The exact position of cutter drum assembly 74 with respect to road surface 90 is controlled by actuation of positioning cylinder 52 by operating positioning control valve 170. Actuation of positioning cylinder 52 will cause positioning control arm 48 to be pivoted about lower pivot 50. Because operating cylinder 58 and operating control arm 64 are connected to positioning control arm 48, and because cutter frame 68 is connected to operating control arm 64, it will be seen that actuation of positioning cylinder 52 will cause cutter drum assembly 74 to be raised and lowered with respect to road surface 90. That is, cutter drum assembly 74 is thus pivoted about axle 88. Preferably, cutter drum assembly 74 is positioned so that cutter elements 82 on cutter drum 80 are just above road surface 90 and not in contact therewith initially. Thus, a cutter positioning means is provided in apparatus 10.

Figure 3:
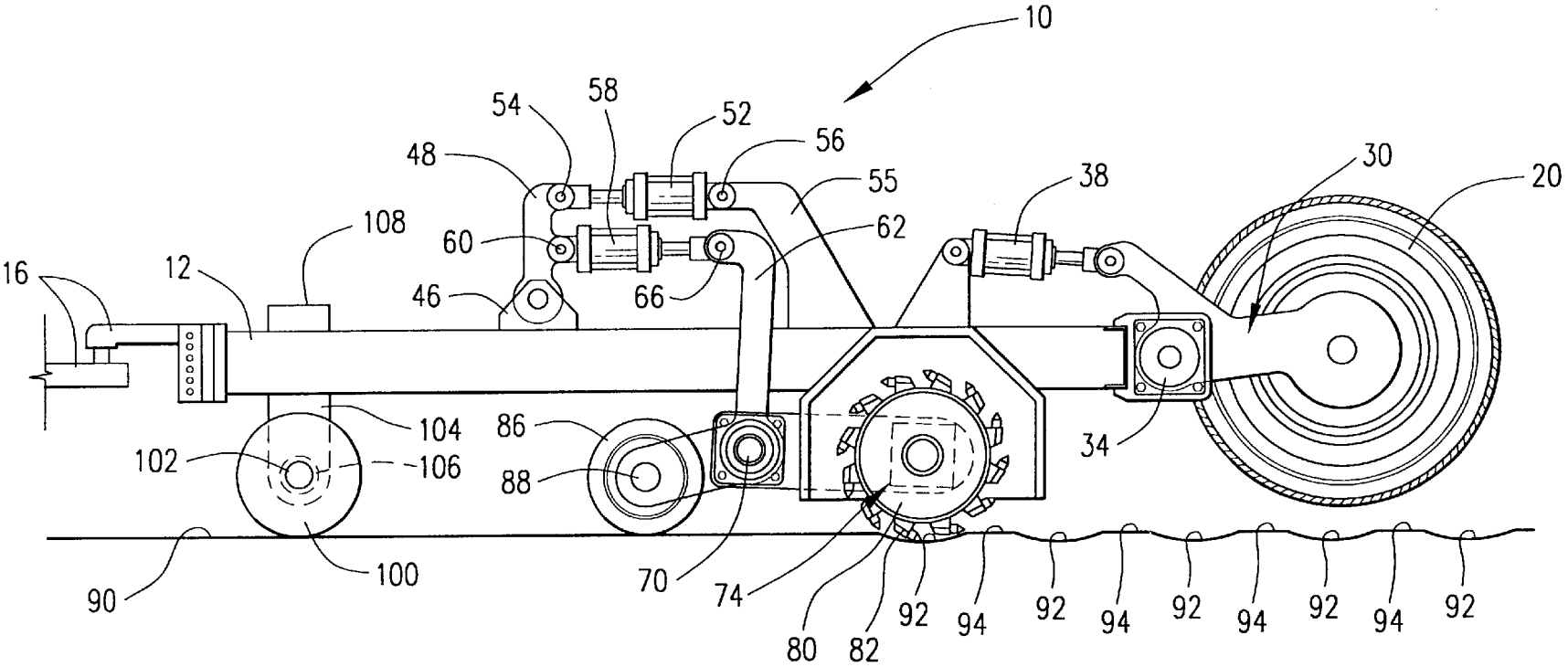
FIG. 3 illustrates the road-cutting apparatus of the present invention in a cutting position for providing spaced grooves along the road surface.

Cutter elements 82 on cutter drum 80 may be brought into cutting engagement with road surface 90 by actuation of operating cylinder 58 to an extended position (see FIG. 3) and disengaged by further actuation of the operating cylinder to a retracted position (see FIG. 2). That is, extension of operating cylinder 58 will cause operating control arm 64 to be rotated clockwise about pivot 70 which lowers cutter drum assembly 74 toward road surface 90 such that cutter elements 82 will cut a groove or impression 92 therein. See FIG. 3. Retraction of operating cylinder 58 will rotate operating control arm 64 counterclockwise about pivot 70, raising cutter drum assembly 74 again to the disengaged position. Referring again to FIG. 3, it will be seen that by alternately extending and retracting operating cylinder 58 as apparatus 10 is moved along road surface 90, a series of spaced grooves 92 may be cut along the road surface leaving an uncut portion 94 between each adjacent pairs of grooves. In this way, apparatus 10 comprises a cutter operating means.

Prior to the cutting operation, first proximity switch 116 and second proximity switch 120 are positioned as desired adjacent to operating cylinder 58 and located there such as by clamping on a support member (not shown) or any other known means. The distance between proximity switches 116 and 120 will determine the total working stroke of operating cylinder 58 and thus the total movement of rod end 124 thereof.

When control circuit 108 is operational, movement of apparatus 10 along road surface 90 results in rotation of measuring wheel 100 and distance counter wheel 106. As each cog 112 on distance counter wheel 106 move past magnetic proximity switch 110, the magnetic proximity switch sends a signal through wires 116 to logic controller 114. Logic controller 114 actuates operating hydraulic valve 126 which in turn actuates operating cylinder 58. That is, logic controller 114 and hydraulic valve 126 determine when operating cylinder 58 is extended and retracted. When operating cylinder 58 is extended, rod end 124 will pass adjacent to first proximity switch 116 which sends a signal to logic controller 114 through wires 118, stopping actuation. When operating cylinder 58 is retracted, rod end 124 thereof moves adjacent to second proximity switch 120, and another signal is sent to logic controller 114 through wires 122 to stop actuation in that direction. Logic controller 114 includes a programmable microprocessor which can be programmed to extend operating cylinder 58 after a preselected number of "hits" sensed by magnetic proximity switch 110 as cogs 112 pass thereby and retract operating cylinder 58 after another preselected number of hits. In this way, the width of grooves 92 and the width of the uncut portions 94 therebetween may be easily and accurately determined. Further, if intermittent cutting is desired, the microprocessor in logic controller 114 may be programmed to leave a larger space between a group of grooves 92 of a preselected number. Thus, all that is necessary to vary the width of grooves 92 and the spacing 94 therebetween and any longer spacing between adjacent groups of grooves 92 is to simply reprogram the microprocessor logic controller 114. It is not necessary to change cutters or cams or other devices as is required in some of the prior art devices.

The positioning of first proximity switch 116 and second proximity switch 120 determines the spacing above road surface 90 when in the disengaged position and the depth of grooves 92 when in the cutting or engaged position. For example, but not by way of limitation, the proximity switches could be set to position cutter drum assembly 74 one-quarter inch above road surface 90 when not cutting and set the depth of grooves 92 to one-half inch when cutting. Other dimensions could also be used as desired.

Throughout the operation of operating cylinder 58, elevating wheels 86 stay in contact with road surface 90 allowing road-cutting apparatus 10 to be guided along the road surface. Trailer hitch 16 and elevation wheels 86 thus provide a three-point contact for apparatus 10 during operation, the hitch being the front pivoting point and the dual elevating wheels 86 providing a movable rear support. This three-point design allows full "flotation" of apparatus 10, resulting in a highly consistent cutting action of cutter drum assembly 74 and correspondingly uniform depths, lengths and spacing of grooves 92.

As cutter elements 82 wear, positioning cylinder 52 may be actuated by operating positioning control valve 170 to compensate so that the cutting edges of cutter elements 82 are maintained in approximately the same position with respect to road surface 90 in the disengaged position shown in FIG. 2. This is normally done manually as necessary.

When the desired portion of road surface 90 has had grooves 92 cut therein, operating cylinder 58 is retracted to the disengaged position by operating transport control valve 154 shown in FIG. 2. Transport cylinder 38 is re-extended to pivot transport control arm 30 about pivot 34, thus lowering transport wheels 20 into engagement with road surface 90 so that apparatus 10 is again in the transport position shown in FIG. 1. At this point, apparatus 10 may then be transported to another desired location with cutter drum assembly 74 and elevation wheels 86 displaced above the road surface.

It will be seen, therefore, that the road-cutting apparatus of the present invention is well adapted to carry out the ends and advantages mentioned as well as those inherent therein. While a presently preferred embodiment has been described for the purposes of this disclosure, numerous changes in the arrangement and construction of parts may be made by those skilled in the art. All such changes are encompassed within the scope and spirit of the appended claims.

What is claimed is:

1. An apparatus for cutting impressions in a road surface, said apparatus comprising:

a tool carrier adapted for moving along the road surface;

a rotatable cutter positioned adjacent to said tool carrier;

a cutter positioning means for positioning said cutter between a raised position spaced from the road surface and an operating position adjacent to the road surface;

a cutter operating means for alternately moving said cutter into and out of cutting engagement with a road surface after the cutter is in the operating position thereof;

a transport wheel attached to said tool carrier and having a transport position engaging the road surface and a retracted position spaced from the road surface; and wheel actuation means for moving said transport wheel between said transport and retracted positions thereof, said wheel actuation means comprising:

a control arm pivotally connecting said transport wheel to said tool carrier; and a cylinder connected to said tool carrier and said control arm whereby said control arm and said transport wheel may be pivoted with respect to said tool carrier.

2. The apparatus of claim 1 further comprising:

a transport wheel attached to said tool carrier and having a transport position engaging the road surface and a retracted position spaced from the road surface.

3. The apparatus of claim 2 further comprising wheel actuation means for moving said transport wheel between said transport and retracted positions thereof.

4. The apparatus of claim 1 wherein said cutter positioning means comprises:

a positioning control arm pivotally attached to said tool carrier; and a positioning cylinder interconnecting said positioning control arm and said tool carrier whereby said cutter may be pivoted between said raised and operating positions.

5. The apparatus of claim 4 wherein said cutter operating means comprises:

an operating control arm attached to said cutter; and an operating cylinder interconnecting said positioning control arm and said operating control arm whereby said cutter may be engaged with, and disengaged from, the road surface.

6. The apparatus of claim 5 further comprising:

an elevating wheel connected to said cutter for supporting said cutter on the road surface when said cutter is in the operating position thereof.

7. The apparatus of claim 6 wherein said cutter positioning means is adapted for pivoting said cutter with respect to said tool carrier for compensating for wear on said cutter.

8. The apparatus of claims 6 wherein said elevating wheel is connected to said positioning control arm and pivotable therewith.

9. The apparatus of claim 6 wherein said cutter operating means is adapted for pivoting said cutter with respect to said tool carrier when moving said cutter between cutting engagement with the road surface and disengagement therefrom.

10. The apparatus of claim 1 further comprising:

means for measuring a distance said tool carrier is moved along the road surface and generating a signal in response thereto; and a controller for actuating said cutter operating means in response to said signal.

11. The apparatus of claim 10 wherein said means for measuring is characterized by:

a distance counter wheel; and a proximity switch adjacent to said distance counter wheel.

12. An apparatus for cutting impressions in a road surface, said apparatus comprising:

a tool carrier adapted for moving along the road surface;

a positioning control arm pivotally attached to said tool carrier;

a positioning cylinder attached to said positioning control arm and said tool carrier;

an operating cylinder pivotally attached to said positioning control arm;

an operating control arm pivotally attached to said operating cylinder;

a transport wheel attached to said tool carrier and having a transport position engaging the road surface and a retracted position spaced from the road surface;

wheel actuation means for moving said transport wheel between said transport and retracted positions thereof, said wheel actuation means comprising:

a transport control arm pivotally connecting said transport wheel to said tool carrier; and a transport cylinder connected to said tool carrier and said transport control arm whereby said transport control arm and said transport wheel may be pivoted with respect to said tool carrier; and a rotatable cutter mounted on said operating control arm; wherein:

actuation of said positioning cylinder moves said cutter between a raised position spaced from the road surface and an operating position adjacent to the road surface; and actuation of said operating cylinder moves said cutter into and out of cutting engagement with the road surface and disengagement from the road surface.

13. The apparatus of claim 12 further comprising:

a transport wheel attached to said tool carrier and having a transport position engaging the road surface and a retracted position spaced from the road surface.

14. The apparatus of claim 13 further comprising wheel actuation means for moving said transport wheel between said transport and retracted positions thereof.

15. The apparatus of claim 12 further comprising:

an elevating wheel rotatably mounted on said operating control arm for supporting said cutter on the road surface when the cutter is in the operating position thereof.

16. The apparatus of claim 15 wherein said positioning control arm is adapted for pivotally supporting said cutter with respect to said elevating wheel, thereby compensating for wear on said cutter.

17. The apparatus of claim 15 wherein said operating control arm is adapted for pivotally supporting said cutter with respect to said elevating wheel when moving said cutter between said engaged and disengaged positions thereof.

18. The apparatus of claim 12 further comprising:

means for measuring a distance said tool carrier is moved along the road surface and generating a signal in response thereto; and a controller for actuating said cutter operating means in response to said signal.

19. The apparatus of claim 18 wherein said means for measuring is characterized by:

a distance counter wheel; and a proximity switch adjacent to said distance counter wheel.

* * * * *